United States Patent [19]

Macera

[11] Patent Number: 4,664,385

[45] Date of Patent: May 12, 1987

[54] GOLF PUTTER

[76] Inventor: John S. Macera, 11 Arbuckle Cres., Nepean, Ontario, Canada, K2G 4V1

[21] Appl. No.: 775,672

[22] Filed: Sep. 13, 1985

[30] Foreign Application Priority Data

Apr. 2, 1985 [CA] Canada ..... 478206

[51] Int. Cl.[4] ..... A63B 53/04

[52] U.S. Cl. ..... 273/167 B; 273/169

[58] Field of Search ..... 273/167 B, 167 R, 167 D, 273/167 G, 168, 175, 167 J, 167 C; D21/217, 218, 219

[56] References Cited

FOREIGN PATENT DOCUMENTS 7550 of 1900 United Kingdom ..... 273/167 B

*Primary Examiner*—George J. Marlo

[57] ABSTRACT

A putter head adapted for attachment to a shaft has at least one planar surface adapted for striking a golf ball at a height greater than the radius of said golf ball to propel said golf ball in a desired direction. Preferably, the ball-striking surface is forwardly inclined at from 20° to 25° from the vertical, and most preferably, at 23.58° from the vertical.

5 Claims, 4 Drawing Figures

GOLF PUTTER

The present invention lies in the field of golf equipment, and more particularly relates to a novel golf putter and a novel golf putter head.

In playing a round of golf, approximately one-half of all of the shots a player will execute during the round will be putts. In fact, golf courses are designed so that if a player is able to reach the green in regulation (one shot on a par three hole, two on a par four, and three on a par five) he is permitted two putts to complete the hole and attain par. Since there are eighteen holes on a golf course, a golfer is permitted 36 putts. Accordingly, it is clear that if a golfer wishes to lower his score, he will want to improve his putting. Moreover, he will want to utilize an effective putter, as about one-half of his shots will be executed with the putter.

To meet the clear demand for high quality, effective putters, golf club manufacturers have proposed a wide variety of different shapes and sizes—even cylindrical—of putters. They have shifted the balance of the putter to be forward of the ball upon impact, and rearward of the ball on impact; they have provided putters with enlarged sweet spots and putters with aiming guides built into them. In Canadian Patent No. 461,375 Nov. 29, 1949, Parrish), a putter having a pair of downwardly depending legs is provided. However, in all known putters, there has been one substantially constant feature. The front ball-contacting face of the putter is generally planar and vertical, so as to contact the golf ball at its mid point. The only two deviations from such a planar, vertical contact face known to the Applicant are the Parrish putter, which has a vertical, planar face, the lower edge of which is designed to graze or "top" a golf ball, and the cylindrical putters referred to above, which have a convex front face designed to contact a golf ball at its mid point.

The problem with all of the aforementioned putters is that they do not function optimally when a golfer executes a natural putting swing. With, for instance, the Parrish putter, the golfer must concentrate on grazing the ground with the "legs" of the putter head whilst the lower edge of the head grazes the ball—he is not permitted to swing the face of the putter head directly into the ball, as is natural, and is the conventional way of contacting the ball. With conventional or cylindrical putters, the golfer is recommended not to swing directly into the ball with a level, natural swing, as this results in an impact on the ball which can cause it to skid, veer and skip away from its desired path to the hole. Rather, some experts recommend that a golfer, in executing a putt with a conventional putter, (that is, any putter having a planar, vertical face) or with a cylindrically-headed putter, position his hands forwardly of the ball, and swing the putter shaft slightly ahead of the ball, to contact the ball on the downstroke, rather than the level portion of the swing. This method of putting is sometimes quite effective, but very difficult to learn, and very difficult for a non-expert to execute.

The basic problem with putter head design is that generally, putters have been designed to strike a golf ball at its mid-point. The Parrish putter is designed to strike a golf ball at a point above the mid-point of the golf ball, but not consistently in the same spot, hence resulting in irratic putting.

The object of the present invention is to overcome the disadvantages associated with known putters, and provide a putter which is effective and fairly easy to use.

In one broad aspect the present invention relates to a putter head with a body adapted for attachment to a shaft, said body having at least one planar surface adapted for striking a golf ball at a height greater than the radius thereof to propel said golf ball in a desired direction.

In drawings which illustrate, by way of example, embodiments of the present invention:

FIG. 5 illustrates the geometry involved in practicing the invention.

Figure 1:
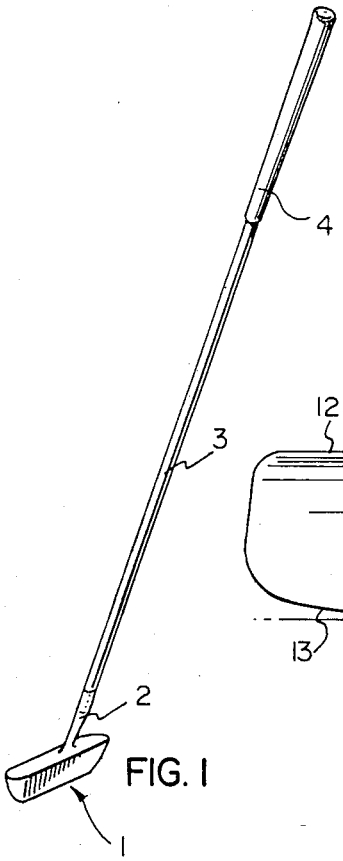
FIG. 1 is a perspective view of a putter according to the present invention.

Referring to FIG. 1, the putter of the present invention includes a head 1 with a shank 2 projecting upwardly from the upper surface thereof, a shaft 3 fixed to the shank 2 and extending upwardly therefrom, and a handle 4 wrapped or otherwise affixed to the upper portion of the shaft. The head 1, shank 2 and shaft 3 may be fabricated from any of many suitable materials, which include brass, stainless steel, aluminum, or other suitable materials or a combination of materials.

Figure 2:
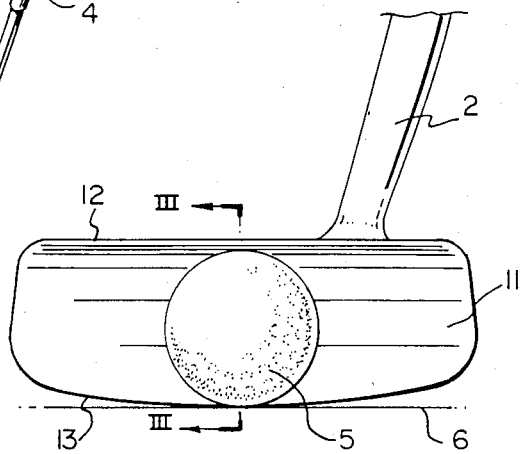
FIG. 2 is a front view of the putter head of the present invention, in contact with a golf ball on a putting surface.
Figure 3:
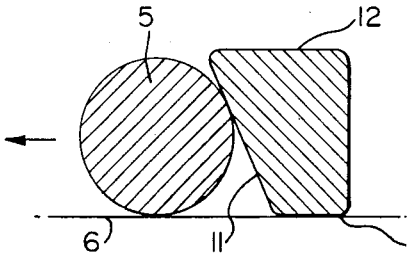
FIG. 3 is a sectional view through line III—III of FIG. 2.

Referring to FIGS. 2 and 3, the position of the putter head 1 at the moment of contact with a golf ball 5 on a putting surface 6 is illustrated. The desired direction of the golf ball 5 is shown two dimensionally by the arrow in FIG. 3. It will be noted that at contact with the ball 5, the shank 2 and shaft 3 of the putter are substantially vertical; this is because the most comfortable, most consistent, and easiest-to-learn putting swing is executed by swinging the putter pendulum-wise into the ball, with the lowermost point of the pendulum swing being the point of impact with the golf ball. Moreover, at contact, the sole 13 of the head 1, will slightly graze the putting surface 6, and the top surface 12 of the head will be parallel to the putting surface 6.

As shown in FIG. 3, the putter of the present invention has a head with a forwardly inclined face 11 for contacting a golf ball 5. This will be discussed in detail below, and in summary, is to cause the putter face 11 to contact the ball consistently at a point on the surface of the ball 5 approximately seven-tenths of the height of the ball 5 above the putting surface. Accordingly, it will be understood that in a preferred embodiment, the vertical height of the putter head should be at least seven-tenths the height of a standard American golf ball (as American golf balls are slightly larger than European golf balls), although a somewhat lesser height will work, depending on the putter swing. A further discussion of the incline of the front face of the putter head follows.

Figure 4:
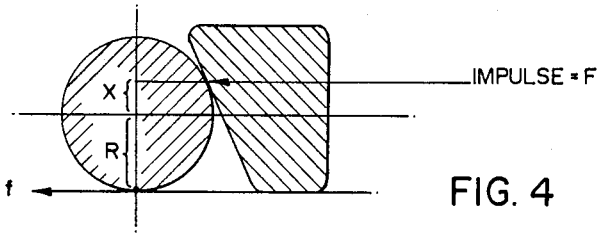
FIG. 4 is the same view as FIG. 3, showing the forces acting on a golf ball.

If the putter head cross-section is as shown in FIG. 4, an impulse will be applied to the golf ball at a height x above the centre of the golf ball, the centre of a golf ball being substantially the centre of gravity in all golf balls. The impulse will cause the golf ball to undergo both translational motion in the direction of the impulse and rotational motion either clockwise or counter-clockwise, depending on the value x, relative to the radius R of the golf ball.

Using Newton's second law of motion, the translation of the golf ball can be expressed as follows:

The sum of forces acting on the golf ball $=\int f(x)dt=Ma$, where M=mass of golf ball, a=acceleration of golf ball, f=forces acting on the golf ball. If we let F=the impulse force, and f=frictional force between the golf ball and the ground, then we obtain:

$$F+f=Ma \tag{1}$$

Since a putted ball will rotate (the golf green is not frictionless), the amount and direction of initial rotation can be determined by applying Newton's second law of motion as it applies to torques. We get:

$$\tau=\int T(x)dt=\text{sum of torques}=I_g\alpha$$

where $I_g$ is the moment of inertia of the golf ball about any diameter.

Therefore:

$$Fx-fR=I_g\alpha \tag{2}$$

Now, since a golf ball is a sphere, we know that its volume $V=(4/3)\pi R^3$ where R is its radius. Also, golf balls are made to have thier centres of gravity as near as possible to their geometrical centres. The two piece golf balls are of substantially uniform density; that is, their mass per unit volume is fairly constant throughout the golf ball. Although the wound golf balls are made differently, their density does not vary substantially enough to render the following equations invalid if we assume them to have a constant density.

The moment of Inertia of the mass of a golf ball about any diameter is defined as the sum of the products of mass and the square of the distance from the diameter throughout the golf ball.

Referring to FIG. 4, if we choose the x-axis as the reference diameter, then $I_x=\int y^2dm$ where dm is the mass at the point y. Now, $dm=\rho dV$ where $\rho$ is the density and V is the volume of the golf ball.

If we consider the right hemisphere, the volume of rotation of a slice about the x-axis is $dV=x^2dy$. Also, for the right hemisphere, $$x=\sqrt{R^2-y^2}\text{. Accordingly,}$$

$$\tfrac{1}{2}I_x = 2\int_0^R y^2\rho\pi x^2dy \tag{3}$$

$$\tfrac{1}{2}I_x = 2\int_0^R y^2\rho\pi(R^2-y^2)dy$$

This is so since the total inertia will be 4 times the moment about the right hemisphere. Now, assuming $\rho$ is a constant, $$\tfrac{1}{2}I_x = 2\pi\rho\int_0^R y^2(R^2-y^2)dy$$

$$I_x = 4\pi\rho\int_0^R (R^2y^2-y^4)dy$$

$$= 4\pi\rho\left(\frac{R^2y^3}{3}-\frac{y^5}{5}\right)\Big|_0^R$$

-continued $$= 4\pi\rho\left(\frac{R^5}{3}-\frac{R^5}{5}\right)$$

$$I_x = \rho\frac{\pi 8R^5}{15}. \tag{4}$$

Equation (4) gives us the moment of inertia of the mass of a golf ball with constant density about any diameter.

But, we know that $\rho=M/V$, and we know V for a sphere. Hence $$=\frac{M}{V}=\frac{M}{\frac{4}{3}\pi R^3}=\frac{3M}{4\pi R^3}$$

Therefore:

$$Ix=\frac{\pi 8R^5}{15} \tag{5}$$

$$=\frac{3M}{4\pi R^3}\cdot\frac{\pi 8R^5}{15}$$

$$Ix=\frac{2}{5}MR^2$$

Substituting equation (5) into equation (2), we get $$Fx-fR=\frac{2}{5}MR^2\alpha$$

We also know that $\alpha$, angular acceleration, is a/R. Therefore $$Fx-fR=\frac{2}{5}MR^2\cdot\frac{a}{R}=\frac{2}{5}MaR. \tag{6}$$

Now, in equation (6), if the golf ball does not slip in either the clockwise or counter-clockwise directions on the putting surface when struck, by merely rolls, the frictional torque f will be zero. Therefore, (6) becomes $$Fx=\frac{2}{5}MaR \tag{7}$$

But we know that F=Ma, and hence $$\text{Max}=\frac{2}{5}MaR \tag{8}$$

or $$x=\frac{2}{5}R.$$

According to (8), if the Impulse is applied at a point x which is 2/5 R above the centre of the golf ball, the torque from a putter which will be applied to the golf ball will not cause clockwise or counter-clockwise rotation; the golf ball will roll free from adverse torques or adverse friction. Since this desired point of impact x is 2/5 R above the centre of the golf ball, it is up 7/10 of the diameter of the golf ball from its bottom.

Hence, to determine the optimal cross-sectional shape of the putter to impart consistently an impulse at this optimal point, we apply some trigonometry and geometry, as illustrated in FIG. 5.

The optimal point of impact is E. Angle BCE=90°+angle FCE. The obtuse angle of the putter face is angle OED=$\theta$. Angle AEO=90−$\theta$. Angle AEC=$\theta$ since angle CEO−90°. Therefore angle FCE=$\theta$, and obtuse angle BCE=90°+$\theta$.

In triangle EDO, since E is 2/5 R above the centre O, DO/EO=sin $\theta$. Hence, $\theta$=arc sin 0.4=23.578°. Accordingly, obtuse angle BCE=113.578°. Hence, if the front face of a putter head has a forward incline, relative to the sole of the putter head, of 113.578°, a golf ball struck therewith will roll smoothly and not jump or dig into the green if, at the time of impact, the sole is substantially parallel to the putting surface. It is desirable to have the face uniformly inclined so that the golf ball will be impacted at the optimal point whether or not the putter is raised from the ground when hitting the golf ball.

I claim:

1. A putter head adapted for attachment to a shaft, said putter head having a horizontal sole portion and at least one planar surface which is forwardly inclined from 20° to 25° from the vertical for striking a golf ball at a height greater than the radius of said golf ball to propel said golf ball in a desired direction.

2. A putter head as defined in claim 1 wherein said planar surface is forwardly inclined from 23° to 24° from the vertical.

3. A putter head as defined in claim 2 wherein said planar surface is forwardly inclined at 23.58° from the vertical.

4. A putter head as defined in claim 1 wherein the angle between said sole portion and said planar surface is from 113° to 114°.

5. A putter head as defined in claim 1 wherein the angle between said sole portion and said planar surface is 113.58°.

* * * * *

UNITED STATES PATENT AND TRADEMARK OFFICE

CERTIFICATE OF CORRECTION

PATENT NO. : 4,664,385

DATED : May 12, 1987

INVENTOR(S) : John S. Macera

It is certified that error appears in the above-identified patent and that said Letters Patent is hereby corrected as shown below:

FIGURE 5, should appear as part of Letters Patent.

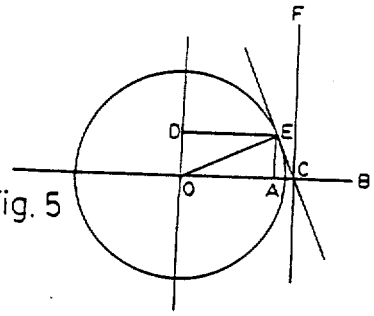

Fig. 5

On the title page, "4 Drawing Figures" should read -- 5 Drawing Figures --.

Signed and Sealed this

First Day of September, 1987

*Attest:*

DONALD J. QUIGG

*Attesting Officer*

*Commissioner of Patents and Trademarks*